US005988491A

United States Patent [19]

Morrison

[11] Patent Number: 5,988,491

[45] Date of Patent: Nov. 23, 1999

[54] BULK BIN PACKAGE AND CAP

[75] Inventor: Mark D. Morrison, St. Louis, Mo.

[73] Assignee: Jefferson Smurfit Corporation, St. Louis, Mo.

[21] Appl. No.: 09/123,222

[22] Filed: Jul. 27, 1998

[51] Int. Cl.[6] ..... B65D 5/56

[52] U.S. Cl. ..... 229/122.32; 229/122.33; 229/125.27; 229/125.31

[58] Field of Search ..... 229/117.27, 117.35, 229/122.32, 122.33, 125.27, 125.31

[56] References Cited

U.S. PATENT DOCUMENTS

| | | | |
|---|---|---|---|
| 1,979,956 | 11/1934 | Boeye . | |
| 2,370,749 | 3/1945 | Perkins | 229/122.33 |
| 2,404,067 | 7/1946 | Hill . | |
| 3,119,542 | 1/1964 | Pomerantz | 229/122.33 |
| 3,343,660 | 9/1967 | Bailey . | |
| 3,397,831 | 8/1968 | Adams | 229/122.32 |
| 4,065,048 | 12/1977 | Pilz, III | 229/125.31 |
| 4,411,373 | 10/1983 | Kupersmit . | |
| 4,706,809 | 11/1987 | Halsell . | |
| 5,069,359 | 12/1991 | Liebel | 229/122.32 |
| 5,437,388 | 8/1995 | Bartelt et al. . | |
| 5,562,227 | 10/1996 | Takezawa et al. . | |
| 5,735,429 | 4/1998 | Whitworth | 229/122.33 |

*Primary Examiner*—Gary E. Elkins
*Attorney, Agent, or Firm*—Paul M. Denk

[57] ABSTRACT

A package including an outer container, with upper narrow flanges, and which can be folded into the container form, and includes interiorly thereof at least one liner, the liner being shaped so as to provide for its interfitting within the container, having clearance on at least two opposite sides from the container walls, while the other two walls of the liner are contiguous with, or adhesively connected to, the interior of the other two walls of the container. The liner has beveled panels, at its corners, so that when the container of the package is folded into a flattened configuration, the liner follows suit, and can likewise be folded simultaneously flat with the container, so that the package blank can then be shipped or stored in that condition. When the package is erected, for filling, the liner shapes into the open configuration, with the container, can be filled with bulk material, and then a particular style of cap formed of a cover panel, with beveled flanges along each edge embrace the narrow upper flanges of the container, to secure the package into closure, at which time it may be banded or otherwise secured into closure.

27 Claims, 5 Drawing Sheets

BULK BIN PACKAGE AND CAP

BACKGROUND OF THE INVENTION

This invention relates in general to packaging, and more specifically to a bulk bin package and cap, especially designed for affording sufficient strength for withstanding extensive internal pressures when laden with bulk material, and in addition, provides a package and its liner that can be adhered together, during the manufacturing stage, the combined components folded into the flat condition, for shipment, but yet can be readily erected for usage without requiring any further manipulation of the liner, with respect to the bin, once the two have been pre-assembled together.

Many styles of bulk bin boxes or containers have long been available in the art. In addition, even containers that included an interior liner, functioning as a bin, have been employed, usually where the liner must be shipped separately from the container, and then inserted into the same, prior to its filling with bulk material. In the prior art, there have even been liners of multi-shapes, including the octagonal shape, for use as an insert, and functioning as a bin, for holding bulk material.

The current invention takes the design a step further, in forming a uniquely shaped liner, or bin, which has been predetermined to have fold lines at particular locations, so that the liner can be inserted at the manufacturing plant into the container, adhesively applied at select surfaces to the interior of the container, wherein both can be folded, together, into a flattened condition, for storage or shipment, and readily available for further erecting into the usable form, at the situs of filing with bulk material.

Examples of some prior art are shown in the earlier patent to Bobye, U.S. Pat. No. 1,979,956, which shows a box, formed of a blank, and wherein its upper flaps are of a narrowed dimension, as can be seen.

The patent to Hill, U.S. Pat. No. 2,404,067, shows a container enclosure therefor. This particular container is pertinent from the standpoint of showing a rectangular carton, which has narrow side flaps, and which cooperate with a particular styled cover to furnish closure for the container, as noted.

The patent to Bailey, U.S. Pat. No. 3,343,660, shows a box closure, which has a series of upper narrow panels, and which cooperate with a lid, such as shown in FIG. 6, to furnish closure.

The patent to Kupersmit, U.S. Pat. No. 4,411,373, discloses a foldable reinforcing element for a shipping container. This element is multi-sided, as noted, generally comes in two parts, and apparently fits in combination within a container to prevent its bulging. The element is formed of corrugated board, and resists bulging and bursting of the container in which the material or cargo is located. This liner, although, is capable of being folded into a somewhat flattened condition.

The patent to Halsell, U.S. Pat. No. 4,706,809, discloses a packaging container for an electric motor. The patent shows a pair of separate, or two structures, that form positioning panels for locating around, apparently, any motor that is disposed upon its mounting plate. The paneled structures also incorporate diagonal panels, at their corners. The combination of a pair of positioning panels does furnish an octagonal type of liner for locating within a container, as noted, but this patent does not describe the usage of this type of packaging container for resisting bulging, as in a bin and cap arrangement, as with the current invention. This particular device is primarily for use for anchoring of a heavy single structure product.

The patent to Bartelt, et al, U.S. Pat. No. 5,437,388, shows another form of container, as noted. Particularly, this container includes an outer element, that has a series of telescoping sleeves, and which are of octagonal shape, having diagonal or beveled corners, for the purpose of providing reinforcement to the overall container, when used.

The patent to Takazawa, U.S. Pat. No. 5,562,227, discloses an anti-bulging bag-in-box design. This is relevant from the standpoint of showing how a bag of bulk material may be arranged within an octagonal inner cylinder, as noted, and then the inner cylinder actually being formed of four parts, is then located within the shown casing. The casing or container is formed with side walls, and an inner cylinder is formed from various panels, that are foldably attached to the sides of these side panels. The structure can form a reinforced inner liner for a container or casing, from a single blank. Although, this is a bag within a box, but all of it being formed from a one-piece blank.

SUMMARY OF THE INVENTION

This invention contemplates information of a bulk bin package, and a cap for use in conjunction therewith, wherein the package is formed from at least two components, an outer container, and an interior liner, wherein the liner is designed and configured containing various fold lines, so that it can be located within its container, both can be folded into the flattened condition, in preparation for subsequent erecting and usage.

This invention relates to the formation of a package, which includes at least a two component structure, a container, and a particularly configured liner, for locating therein. The liner is fabricated with particular fold lines, to facilitate its collapsing into a flattened condition, even after it has been applied, and perhaps even secured with an adhesive, to the interior of the container, so that both may be stored or shipped flat, in preparation for subsequent usage.

The container portion of the package can be fabricated in the usual configuration for a container, having four walls, bottom flanges to afford closure, and upper flanges that likewise can provide closure to the container, in the usual manner. But, as a further improvement to this invention, the upper flanges are designed of shallower width, so that when folded over into a closure-like disposition, they can cooperate with a particularly styled cover, to assure closure to the package, when filled with a bulk material. But, it should be stated at this stage that the upper flanges for the container may likewise be formed in a similar manner to the bottom flanges for this container, and simply be folded over into closure, and used in combination with the specially designed interior liner, affording the dual collapsing of both the container and its liner into the flattened condition, as stated.

The interior liner of this invention is formed from a multi-sided paperboard, into four major walls, but forming at their corners, minor beveled walls, which have been predesigned including fold lines, along their heighth, that allows for the combined collapsing of the liner, with its surrounding container, into the flattened condition, when employed. And, in the preferred embodiment, two of the major panels for the liner, oppositely disposed from each other, are adhesively or otherwise secured to the interior of two contiguous walls of the container, while the two other and opposite walls are spaced inwardly, and have an intermediate clearance between their liner walls and the interior proximate other walls of the container, when the liner is fitted within its container. As designed in this manner, the combination container, and its interiorly applied liner, can both be collapsed together, into the flat condition, for storage or shipment, as previously described.

But, when the package is erected into the usable form, at the situs of its application, it can be folded once again into the rectangular configuration, its bottom flanges folded into closure, wherein the bulk bin package is ready for filling and shipment. When erected into that condition, the beveled corner walls for the liner, in combination with the adjacent walls of the container, form triangular like voids, in the four corners for the package, and in that position are suitable for the inserting and reception of corner posts therein, for additional stacking strength, in the event that a bulk laden package of this invention is rested upon another, during usage or storage.

The cap of this invention, in the preferred embodiment, is formed as a cover panel, with edge flanges extending from each side edge of the said panel. Each edge flange has a fold line arranged approximately centrally thereof, so that each flange can be folded over into a dual flange configuration, and it is between these dual flanges that the narrow upper flange of the container inserts, when the package is closed, after filling with a bulk material.

Hence, the advantages of this invention, for a package fabricated in the manner as summarized herein, are many fold. For example, initially, the package, including its container, and certainly the bin located therein, when filled with a bulk material, may be subject to some bulging, due to the significant weight of the bulk material located therein. And, this may also occur when the package is being lifted, transferred, or otherwise manipulated, during its usage and application. Hence, the clearance between the liner, of this invention as described herein, and the interior of the container, affords some room for bulging, at least of the liner, during application. And, in the event that any bulging occurs also to the outer container, the fact that its narrow upper flanges locate intermediate the folded cover flanges, provides a basis for the container flange to shift therein, compensating for any bulging that have occurred even to the container, when employed and filled with bulk material and handled under rather rigorous conditions. The entire package, once assembled, including its container, the liner, and the closure cap, when assembled, and filled with a bulk material, can be banded into closure, or otherwise secured through the use of banding, strapping, tape, string, or other forms of retention means. These are just examples.

It is, therefore, the principal object of this invention to provide a uniquely designed package, embodying a container, and a bulk liner inserted therein, wherein the liner is configured in a manner that allows for its collapsing simultaneously into a flat condition, as its container is likewise flattened, for shipment or storage.

Another object of this invention is to provide a liner for a bulk material package which is configured having a series of major and beveled walls, that cooperate to allow for collapsing of the liner simultaneously with any package in which it is applied.

Still another object of this invention is to provide a uniquely designed package, for bulk material, wherein only a pair of opposite walls of a liner may be adhesively or otherwise secured to the interior of its container, while the opposite major walls are left with clearance, to compensate for any bulging, and allow for collapsing of the combined container-liner, when folded into a flattened condition.

Still another object of this invention is to provide the designing of beveled minor walls into a liner and which facilitates its collapsing into a flattened condition, when not in use, but readily erected into its rectangular form, for immediate reception of any bulk material, during usage.

Yet another object of this invention is to provide a standard flanged lid and base for a container which provide upper and lower closure, respectively, to a bulk package during usage.

Still another object of this invention is to provide a uniquely designed cap, formed as a cover panel, and which cooperates with upper narrow flanges for a container, so as to compensate for any bulging when the package is filled with bulk material, even after it has been banded into closure.

Yet another object of this invention is to provide a unique liner, for application within a container for a bulk bin package, wherein the liner is configured not only to allow for its collapsing, into the flattened condition, in conjunction with its container, but likewise provides corner clearance for the insertion of corner posts, to facilitate and reinforce stacking of one laden package upon another, when shipped or stored.

These and other objects may become more apparent to those skilled in the art upon reviewing the summary of this invention, as studied in combination with the description of its preferred embodiment, as viewed with the drawings.

BRIEF DESCRIPTION OF THE DRAWINGS

In referring to the drawings, FIG. 1 discloses the fully banded bulk bin package of this invention.

DESCRIPTION OF THE PREFERRED EMBODIMENT

Figure 2:
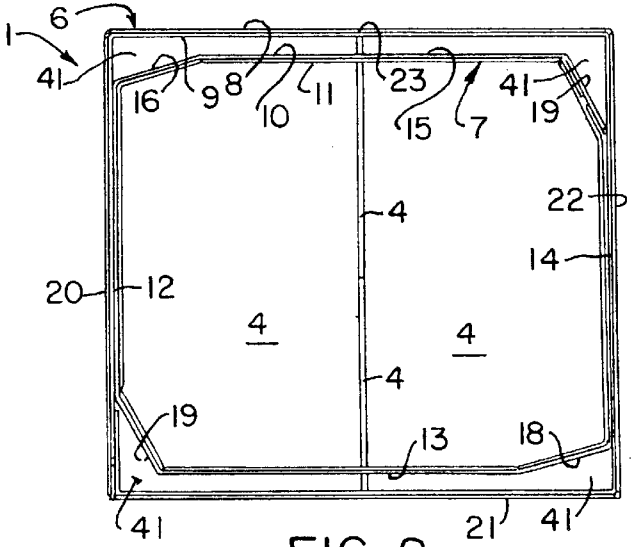
FIG. 2 provides a top view, with the cover panel and flanges deleted, disclosing the interior liner located within the container of this bulk bin package.
Figure 1:
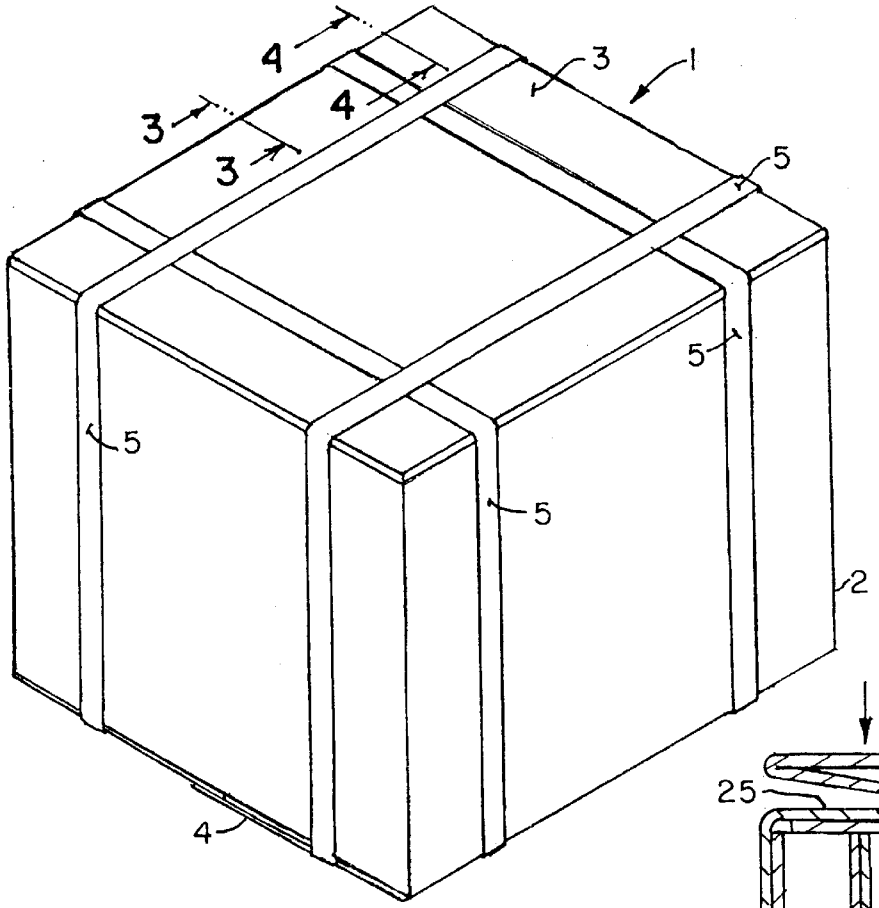

In referring to the drawings, and in particular FIGS. 1 and 2, the bulk bin package and cap of this invention, as shown in 1, is readily displayed. As can be seen, the package 2 has its upper closure cap 3 applied thereto, while its bottom closure flanges 4 are folded over into closure, to provide coverage to the bottom of the shown package. A series of bands, as at 5, are tightly wrapped about the package, to assure its closure, particularly when laden with a bulk and heavy material.

For example, the package of this invention has been tested wherein 3,000 pounds of tomato paste, enclosed within a polyethylene bag, and located within a single package of this invention, was tested both for ability of the package to withstand that type of weight, and potential bulging, to determine whether a package containing that type of weight of paste could withstand the stacking test, in order to determine compressive strength of the bin, and in that test, packages containing that type of weight were filled and stacked three and four high, outdoors, for a number of months. In addition, several of the paste laden bins were ship test, including unloading test, to determine their durability during handling. The ship test included the transfer of packages of this type on a flat bed, for some distance, in order to evaluate the effects of short distance truck shipment on the packages, and their contained bins, during usage in holding bulk material of this magnitude and weight. During storage, and also during shipment, the bins performed properly, and arrived in excellent condition, with no damage.

The actual container 6 for the package, with its internally arranged liner 7, is readily disclosed in FIG. 2. In this particular instance, and in the preferred embodiment, the container is shown having an outer container member 8 with a reinforcing container or liner 9 arranged contiguously therein. In addition, the liner 7 includes the formed liner 10 in addition to a reinforcing liner 11 contained therein. But, the number of liners 7 contained within the package, or the number of containers with internal containers or liners 6, depends upon the weight characteristics required for the type of bulk material being packaged. For example, a single container, with a single liner, may work for the packaging and handling of one type of product, whereas double or triple containers and liners, may be necessary for other product. Furthermore, the various containers and liners may likewise be formed of single wall, double wall, or triple wall paperboard, once again, depending upon the structural requirements needed for packaging a particular type of bulk material being handled. It is believed that these are within the scope of one skilled in the art as to the degree of type of paperboard, or number of liners or containers that may be required, to meet the specifications for the particular product being packaged, stored, or shipped.

It can also be seen in FIG. 2 that the bottom flaps 4, are folded over into closure.

Figure 15:
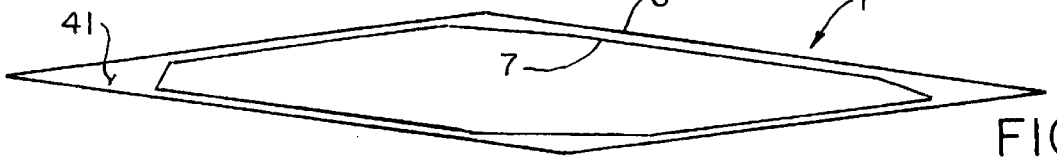
FIG. 15 shows a schematic view disclosing the container and liner during the process of folding over into the flattened configuration.

As can also be noted in said FIG. 2, the configuration for the container 6 may be formed as a square, it can be rectangular, or it also might undertake some form of multi-sided package. But, the interior liner 7, as noted, is fabricated in a particular manner, having side walls 12 through 15, as noted. In addition, each of the liners includes a series of beveled panels or walls, 16 through 19, in order to accommodate the sliding of the liner into the container 6, during assembly, but also for other purposes, as herein explained. For example, in this particular embodiment, it can be seen that the liner walls 12 and 14 are arranged in close proximity if not contiguous with the container walls 20 and 22, as noted. And, there is clearance provided between the liner walls 11 and 13, and their proximate container walls 21 and 23, as can be seen. The purpose for this, as previously summarized, is that when the liner is configured in the manner shown, and located within the container 6, these two components of the package can be folded, together, into a flattened condition, for storage, or for shipment to the customer. This is allowable due to the presence of the beveled panels 16 through 19, intermediate the liner walls, in the manner shown, in addition to the clearance furnished with respect to the container walls 9 and 13. As designed in this manner, the entire package can be erected, as shown in FIG. 2, ready for usage, and available for reception of any bulk material therein, as previously explained in the foregoing example. And, the same package 1 can be folded over into a flattened condition, as can be seen in FIG. 15, showing the package in the process of being folded into its flattened configuration, showing its container 6 and liner 7 in a stage of folding.

In the relationship between the liner 7, and its outer container 6, the walls 12 and 14 of the liner may be adhesively connected to the interior of the container walls 20 and 22, in order to assure proper positioning of the liner, with respect to the container, and allow the same to accommodate that folding into the flattened position. But, it has also been found, through experimentation, that even if the liner walls 12 and 14 are not adhesively secured to the container walls 20 and 22, but are still maintained in contiguity therewith, that the liner 7 has a tendency to shift, on its own, within the container 6, and undertake a centering position, in the manner as shown in FIG. 2, that allows for the package 1 to yet be folded into the flattened configuration, as the package is folded into a planar disposition, as previously explained.

Furthermore, because there is clearance provided between the liner panels 13 and 15, and the associated container walls 21 and 23, the walls 13 and 15 have a tendency to absorb any bulging, when the package is laden with bulk material, within the confines of the container 6, without any outward manifestation of such bulging, since the liner is located, with clearance, internally of the erected package 1, as noted.

Figure 5:
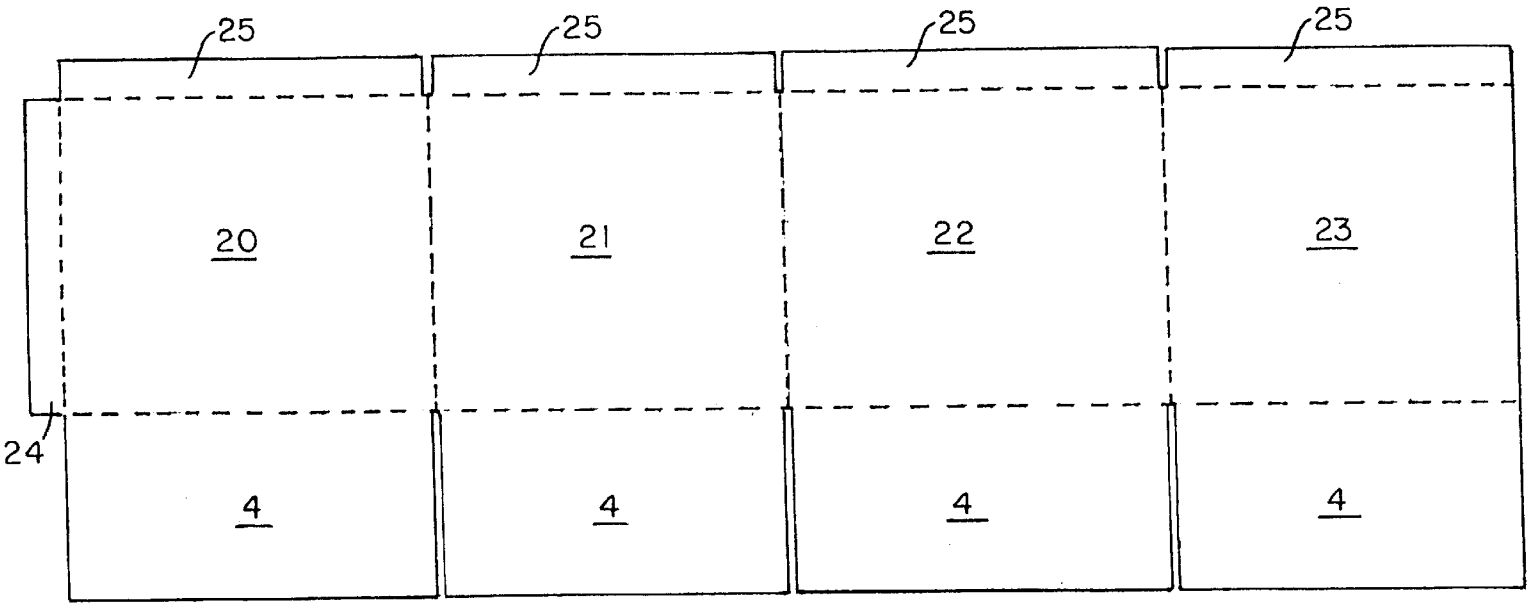
FIG. 5 shows the blank for the outer container for the package of this invention.

The configuration for the outer container 8, for the shown package, is disclosed in FIG. 5. As can be seen, it includes its various walls 20 through 23, and as a manufacturers joint flange 24, provided along one edge, as noted. The bottom flanges 4 are likewise hingedly connected by the fold lines to the bottom of each of the container walls, as noted. When these are folded over, they provide closure to the bottom of the package. Extending upwardly from the upper edges of each of the container walls 20 through 23 are a series of narrow upper flanges 25, which likewise are folded over into a closed position, when the package is erected for usage, and cooperates with the cap 3, in a manner as to be subsequently described.

Figure 6:
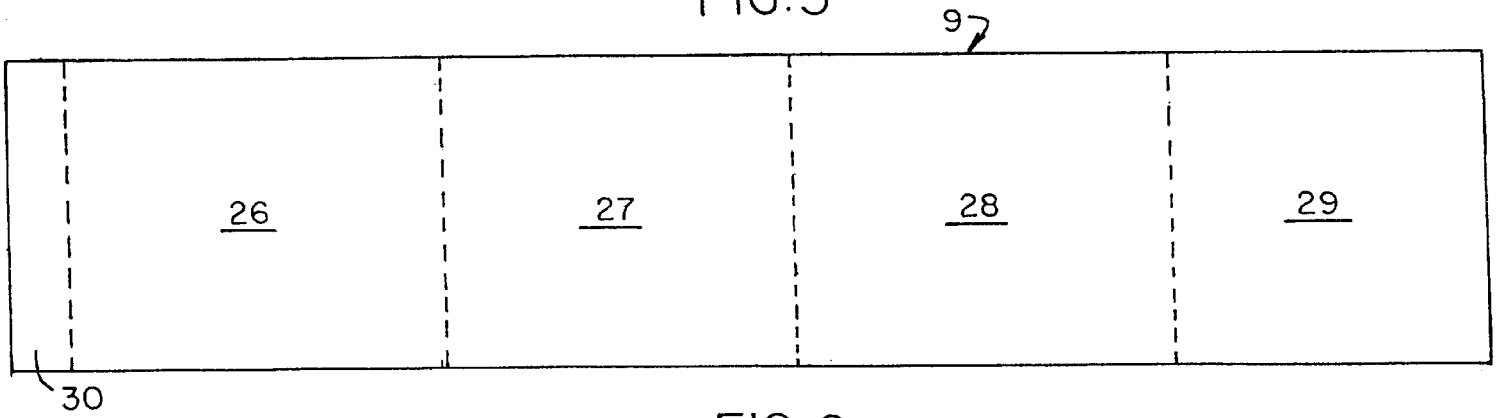
FIG. 6 shows an additional liner fitment may locate within the container blank during its folding, so as to furnish a single wall, double wall, and triple wall container for the bulk bin package of this invention.
Figure 7:
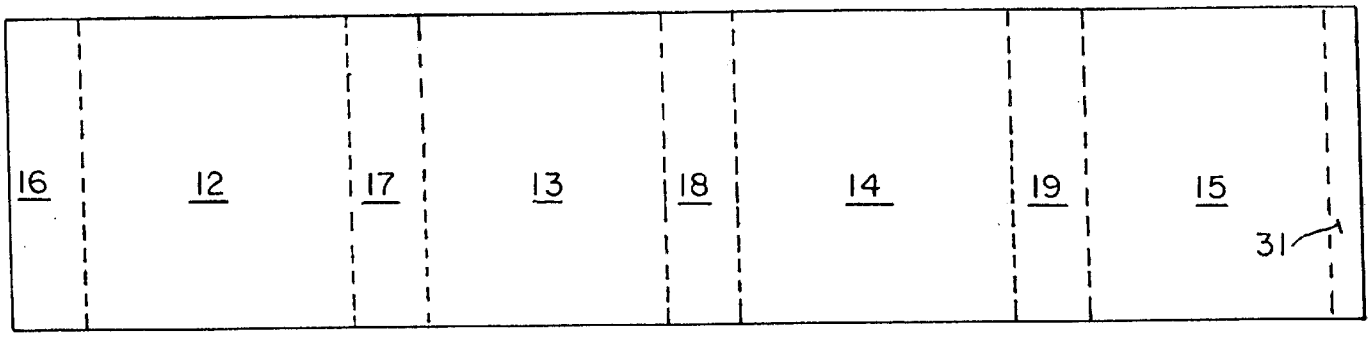
FIG. 7 shows the blank for the inner liner of this invention.
Figure 8:
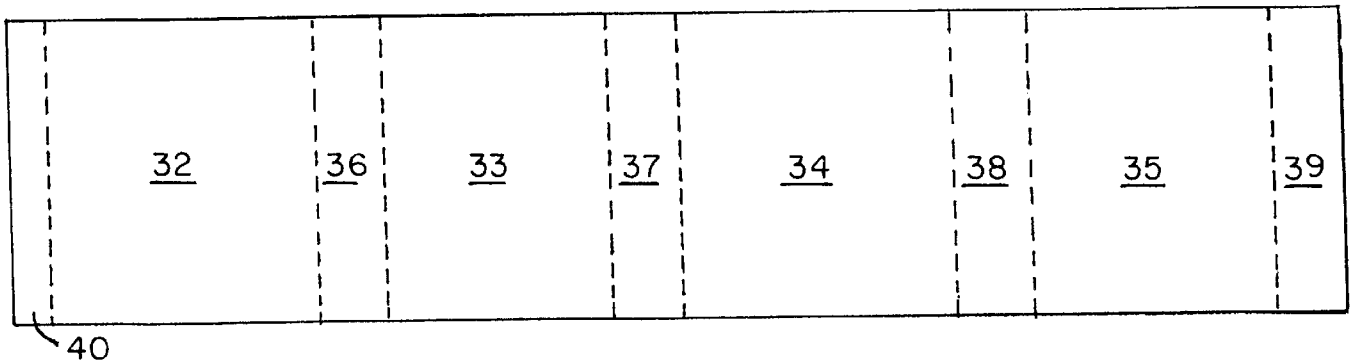
FIG. 8 shows how an additional interior liner may be applied in conjunction with the liner of FIG. 7, so as to provide a double wall or triple wall configuration for the liner depending upon the strength needed for the bulk material being packaged.

The reinforcing container liner 9 is shown in FIG. 6. This liner, if used, also includes a series of walls 26 through 29, which are disposed for arrangement contiguously with the inner surface of the previously described walls 20 through 23, for reinforcement purposes. This container liner also includes a manufacturers joint formed as a glue flap 30, to afford this container liner with closure.

The liner 7 is formed from one or more paneled members, as previously explained with respect to the liners 10 and 11, as previously reviewed. The liner 10 includes a series of liner walls 12 through 15, and includes manufacturers joint 31 along one edge. In addition, those series of beveled panels 16 through 19, as previously explained, are likewise shown. When folded over into closure, to undertake the configuration for the liner 10, as previously explained, this liner can slide into the interior of the container 6, to undertake the configuration as noted in said FIG. 2.

In addition, the reinforcing liner 11 is likewise shown, if such is used, and includes a series of liner walls 32 through 35, and which are designed for contiguously locating, or adhesively securing, to the interior of the corresponding liner walls 12 through 15, as previously explained. In addition, beveled panels 36 through 39, are provided for being located, adhesively secured with, or in close sliding contact with, the interior of the panels 16 through 19, as also previously explained. Obviously, whether or not the container liner 11 will be used, or additional container liners for that matter, depends upon the bulk weight of the material being deposited within the package 1 of this invention. This container liner 11 also includes a manufacturers joint 40, to afford it with closure.

Figure 9:
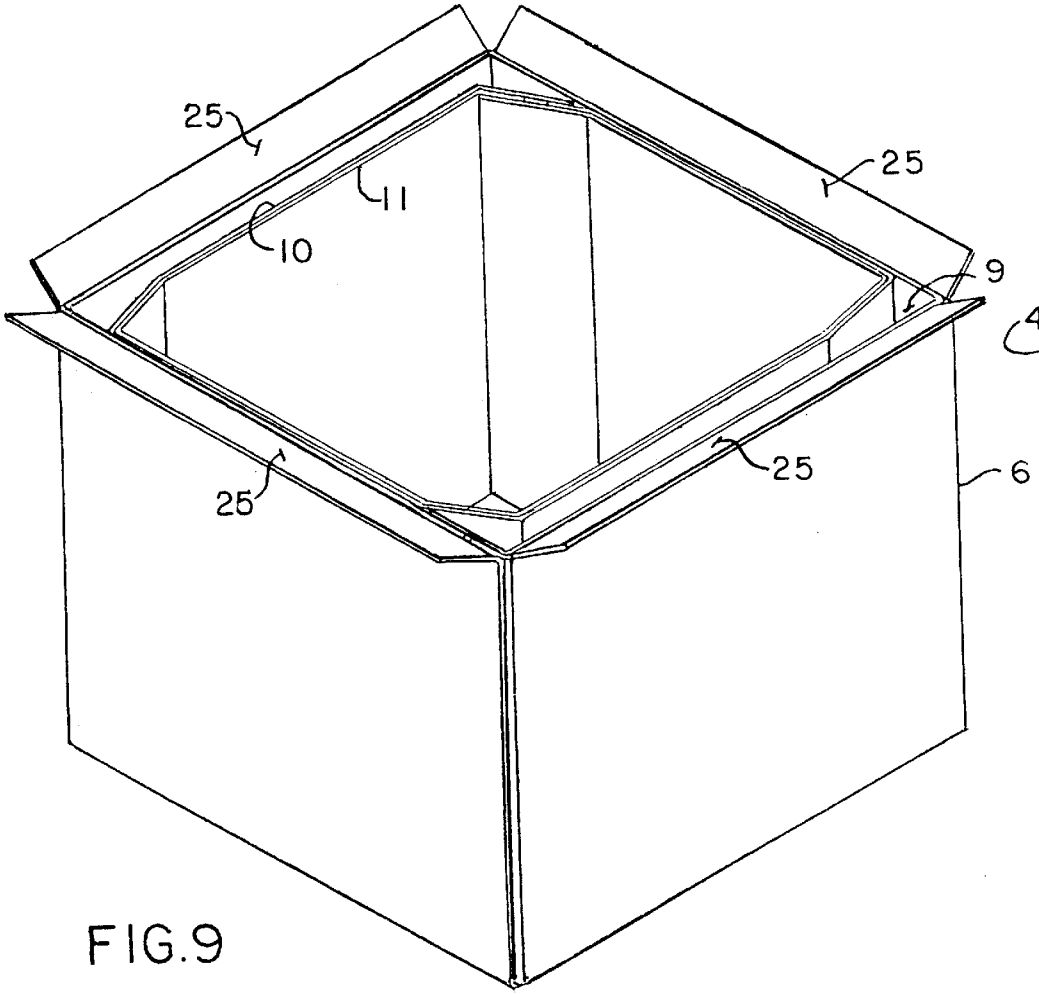
FIG. 9 shows the inner liners folded and located within the outer container for the bulk bin package of this invention.

The locating of the various reinforcing liners 10 and 11, within the container 6, can be seen from FIG. 9.

Another feature of this invention, as can be readily determined from both FIGS. 2 and 9, is the fact that clearance, as at 41, is furnished proximate the corners of the container 6, relative to the liners 7. When the package is erected for usage, as can be seen in these figures, correspondingly shaped corner posts (not shown) may insert within these areas, in order to further rigidify the package, and to substantially add to the stacking strength of the packages, when laden with bulk material, and stacked one upon the other as during storage or shipment.

Figure 12:
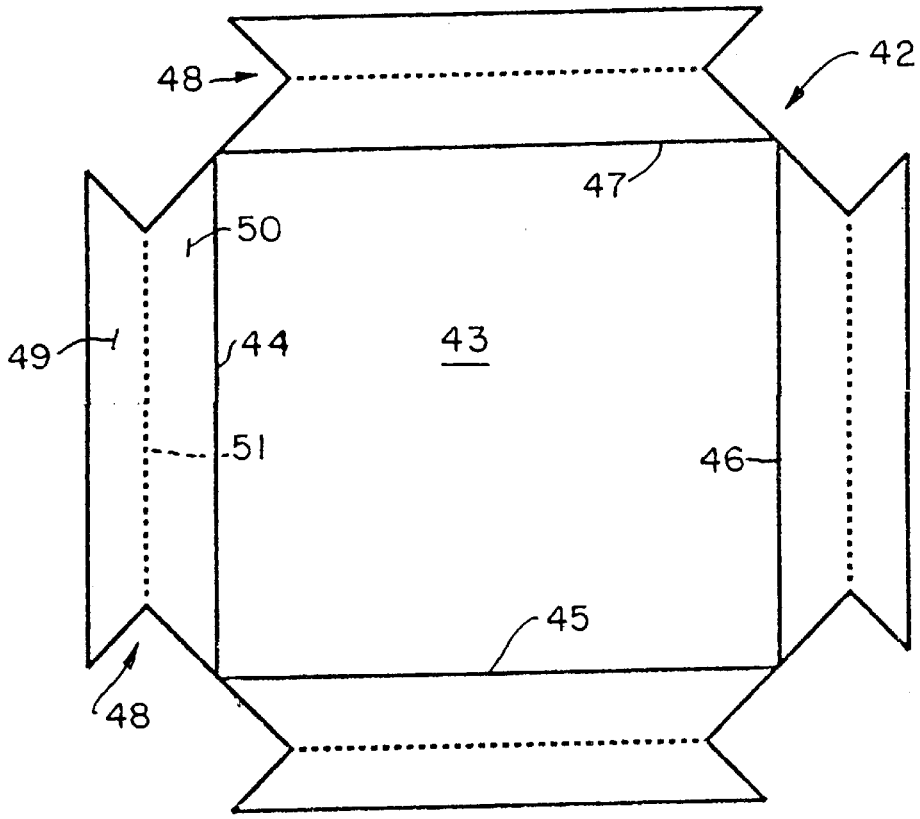
FIG. 12 shows a blank for the cap and its cover panel for this invention.
Figure 13:
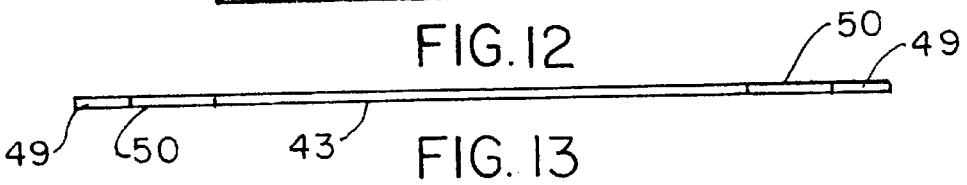
FIG. 13 is an edge view thereof.
Figure 14:
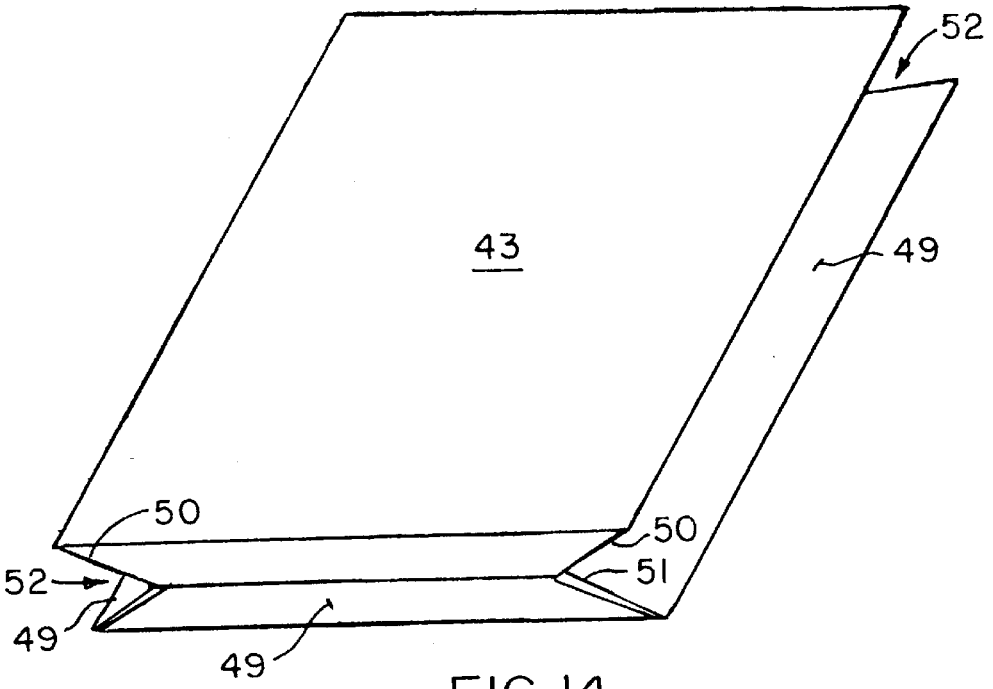
FIG. 14 shows an isometric view of the cover panel and its edge flanges during folding into the cap configuration.

The particular cap or closure member for this invention is readily disclosed in FIGS. 12 through 14. The cap 42 is formed as a cover panel 43, and which has a series of edge flanges 44 through 47 foldably connected thereto. Each of the flanges includes a design cut bevel, as can be seen in 48, at their side edges, in order to accommodate the locating of the upper side wall flanges 25, of the shown container 6, particularly when these upper flanges are folded over into a closed disposition.

Each of the cover flanges 44 through 47 are fabricated as a pair of hinged flanges, as at 49 and 50, provided with a fold line 51 approximately between each of these flanges, and which locates at the apex of the bevel 48, as previously explained. Thus, during the folding of the cap 42 into a condition for application to the top of the container 6, of the package 1, these edge flanges 44 through 47 are folded about their fold lines 51, to furnish an inwardly clearance area, as at 52, so that the adjacent upper wall narrow flange 25 of the container 6 may insert, being sandwiched between the pivotal and foldable flanges 49 and 50, entirely around the periphery of the cap 42, and embrace all of the upper flanges 25 therein, during sealed closure of the package after laden with heavy bulk material.

This is an example of the configuration of the uniquely designed cap 42 of this package, which when used in combination with the package container 6, can provide upper closure to the package, but at the same time, in the event that any bulging occurs to the package, during usage, and pushes the upper wall flanges 25 slightly outwardly, they can slide intermediate the folded flanges 49 and 50, to yet hold the package into closure, and accommodate any bulging that may occur to the container, and the package, during rigorous usage.

But, as previously explained, it is likely that under certain conditions that the upper wall flanges 25, of the container 6, may simply be formed in a manner similar to the flanges 4, and folded over into closure, and yet function desirably for furnishing closure to the package, during usage, but yet accommodate the collapse flat of the container and its liner as previously described. But, this particular cap 42, as explained herein, is a unique addition to the packaging system described herein, for holding heavy bulk material, during shipment or storage.

Figure 4:
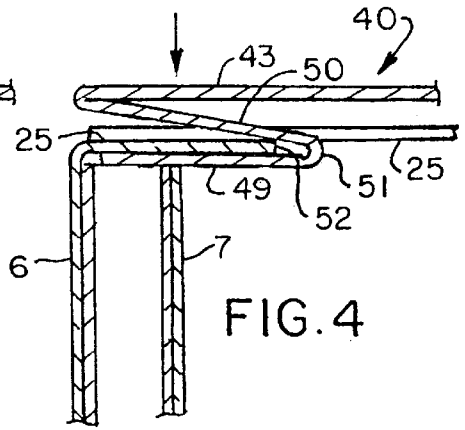
FIG. 4 is similar to FIG. 3, but showing the upper container flange on an adjacent wall, and how clearance of the cover panel accommodates the fold over for that adjacent cover flange during closure performance.
Figure 3:
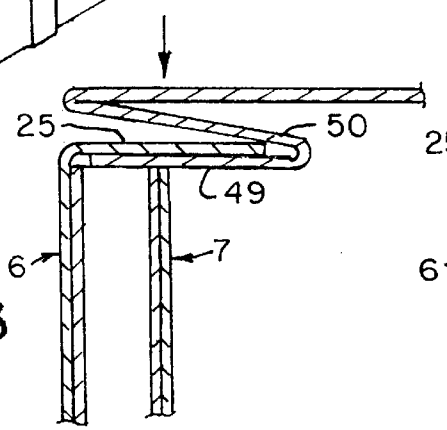
FIG. 3 shows the cover panel, and its attached edge flanges, securing by embracing the upper flange of the container, during closure of the package.
Figure 10:
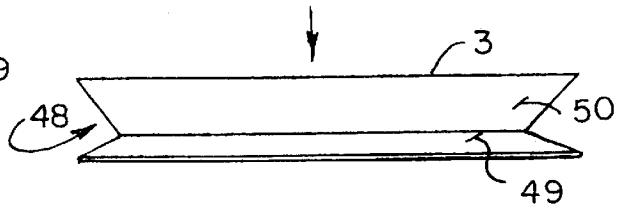
FIG. 10 shows how the cover panel, forming the cap, has its edge flanges folded for embracing the upper narrow flanges for the container of this invention during closure.
Figure 11:
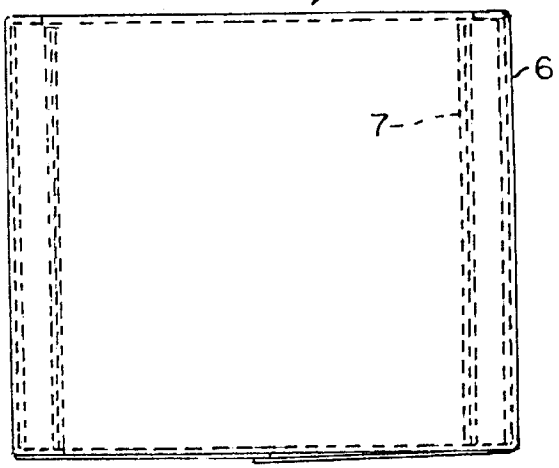
FIG. 11 shows the package for this invention during closure.

As can be seen in FIG. 10, as the cap is moved downwardly into the location for providing closure to the top of the package, its pivotal flanges 49 and 50 are bent inwardly, and due to the beveled edges 48, allow for the cap flanges to mate together, at their ends, when the cap is installed, due to the approximate 45° bevel provided at each edge of the shown flanges. In addition, as can be seen in FIGS. 3 and 4, the flanges 49 and 50 embrace intermediate thereof the upper narrow wall flange 25 of the container 6, while the interior liner 7 has clearance between it, and the container wall, when they are disposed proximate the container walls 21 and 23, of the container 6, as can be noted. In addition, as can be seen in FIG. 4, the bevel 48 at the corners of the various flanges also allows clearance for the fold over and locating of the next adjacent flange 25, of the container 6, as can be seen. The liners 7 have a height slightly less than the height of the container 6, so that adequate clearance is provided for the various pivotal flanges 49 and 50, as the cover panel 43 of the cap 42, and its various flanges are lowered into closure. It can be seen that there is clearance between the end of 52 and the fold point 51 of the cap flanges, so as to allow for the sliding movement of the upper flange 25, and its locating intermediate the said flanges 49 and 50, in the event that any bulging occurs to the package when its liner is laden with heavy bulk material. FIG. 11 discloses how the cap 42 lowers into a flush arrangement upon the top of the container 6, and its liner 7, as the package has been urged into closure, at which time, the various bands 5 will then be applied, to secure the package, ready for shipment or storage.

As can be further noted in FIG. 15, as the carton is erected, from the flat condition, the multi or 8-sided interior liner 7 begins to form those triangular areas 41 within the four corners of the rectangular or square container 6. Thus, the corner post can then be inserted therein, to enhance the stacking strength for the package, when used.

Thus, there is herein formed a package, which consists of, but is not limited specifically to, a rectangular, formed as a corrugated bulk box, with an interiorly arranged liner, which may be integrally glued to the interior of the container, at least along two opposite surfaces, or it may be slidingly located therein, to provide for its self centering, and which allows for the package to be collapsed into the flattened position, as during storage or shipment. This invention includes the inner fitment with a bulk materials package, whether it be a polymer formed of polyethylene, or any other means for holding the bulk material, particularly where the bulk material may comprise not only granular matter, but moist or wet type of materials, such as tomato paste, etc. The interlocking functionality of the cap, with the flanges of the exterior container provides a smooth innerface that can be easily constrained such as by the various methods of banding, strapping, taping, gluing, or the like, as previously referred to. In addition, the intermitting relationship between the upper flanges, arranged intermediate the pivotal flanges of the cap, disposes the upper flanges at approximately a 90° angle with respect to the container walls, and therefore, furnishes another form of reinforcement that has a tendency to resist bulging, at least at the upper edge of the package, when filled with bulk material. And, the interfitment of the lid to the container, unlike other conventional lid/body connections, includes the novelty that it can be effected even when the body is experiencing moderate amounts of bulge, at least at the upper edge of the package, when filled with bulk material. And, the same can be accommodated even during the filling process, even before the cap is applied thereto. Obviously, the arrangement of the corrugations, whether it be horizontal or vertical, within the formed package, for either its liners and/or container, further adds strength to the package when formed. Furthermore, because of the unique structure of the cap, having a pair of pivotal flanges along each edge, which intermate with the narrow upper flanges for the container, form a type of seal that inhibits access and restricts pollen or other insect infestation into the package, once laden with bulk material. Furthermore, it is possible that additional corrugated reinforcement, in addition to the liner, or the interior liner, as previously explained, and which may locate proximate the bottom third of the container, during the filling process, such as through the use of a shallow tray, or the like, may further add to its reinforcement. These are examples as to how the package of this invention may be slightly modified, to add strength, and resist against the forces of bulging, that normally occur when a package of this type is laden with very heavy bulk material.

Variations or modifications to the subject matter of this invention may occur to those skilled in the art upon reviewing the invention as disclosed herein. Such variations or modifications, if within the spirit of this invention, are intended to be encompassed within the scope of any claims to patent protection that are obtained herein. The description of the preferred embodiment, in view of its drawings, are set forth for illustrative purposes only.

Having thus described the invention what is claimed and desired to be secured by Letters Patent is:

1. A package for use for holding bulk material and which because of its weight may have a tendency to normally bulge the walls of its packaging, including, a container, the container having a series of walls, the walls have an interior and exterior surface, a bulk material bin located within said container, said bin having a series of walls, at least one of said bin walls being connected with the interior surface of one of said container walls, and at least one other bin wall being spaced inwardly from the interior surface of another of the container walls, to provide reinforcement for the bulk bin holding a supply of bulk material, and to provide clearance intermediate said walls to allow said spaced bin wall to slightly bulge when the package is filled with bulk material, and wherein said container and its bin can be folded together into a flattened condition.

2. The package of claim 1 wherein said 1 bin wall is connected by spot adhesive to the interior surface of the container wall to which it connects.

3. The package of claim 1 wherein said bin wall connects by a line of adhesive to the interior surface of the contiguous package wall to which it connects.

4. The package of claim 1 wherein said bin wall adhesively connects over its approximate entire surface to the contiguous interior surface of the bin wall to which it connects.

5. The package of claim 1 wherein said bin has at least two walls adhesively connected to the interior surface of their contiguous container walls.

6. The package of claim 5 where in said bin has at least two walls spaced inwardly from the interior surface of two contiguous walls of the package container in which said bin inserts.

7. The package of claim 5 wherein said bin walls connecting with the interior surfaces of the container walls are spaced opposite to each other.

8. The package of claim 6 wherein the bin walls spaced from the interior surfaces of their respective container walls are arranged opposite from each other within the package structure.

9. The package of claim 1 wherein said bin has two opposite walls adhesively connected to the interior surface of two opposite walls of the package in which said bin inserts, and said bin has two additional opposite walls spaced inwardly from the interior surface of the adjacent package walls of the package in which said bin inserts.

10. The package of claim 9 wherein there are beveled walls intermediate each adjacent wall of the formed bins for the structured package.

11. The package of claim 10 where in said beveled walls extend the full heighth of the bin structure.

12. The package of claim 11 wherein said container includes bottom flaps, operatively associated with the bottom edge of each container wall, and which when folded provide closure to the bottom of the said package.

13. The package of claim 11 including upper flaps extending a short distance above the upper edges of the side walls for the container, said upper flaps disposed for folding inwardly for a short distance at the top of the container during closure of the package.

14. The package of claim 13 and including a cover cooperating with the upper flanges of the container, and which when connecting therewith, provides closure for the package during usage.

15. The package of claim 14 wherein said cover includes a cover panel, a series of cover flaps extending from each side edge of the cover panel, each cover flap having a pair of flanges, said flanges being hingedly connected to each other, and said flanges provided for cooperating with the upper flaps of the container, for securement of said package into closure.

16. The package of claim 15 wherein the said pair of flanges extending from each side of the cover panel are beveled at their side edges, to facilitate their cooperating with the upper flanges of the container to provide closure for the package.

17. The package of claim 16 wherein each pair of cover flanges, when folded, embracing an adjacent upper flange of the container intermediate thereof to provide secure closure for the package when filled with bulk material.

18. The package of claim 17 and including at least one band encircling the container and the cover panel to provide secure closure for the package when used.

19. The package of claim 18 wherein there are at least a pair of bands encircling the container and cover panel during closure.

20. The package of claim 19 wherein their are four bands circling the container and cover panel for providing closure to the package.

21. The package of claim 1 wherein the container has a liner located therein and disposed intermediate the bin and the interior surface of each container wall, to add reinforcement to the package during usage in packaging of bulk material.

22. The package of claim 1 where in said bin and container are fabricated of corrugated paperboard.

23. The package of claim 14 wherein said cover is fabricated of corrugated paperboard.

24. The package of claim 17 wherein the upper flanges of the container are arranged intermediate and embraced by the folded cover flanges provides for sliding of the container flanges within the cover flanges to compensate for any bulging to the container when laden with bulk material during handling.

25. A package for use for holding bulk material and which because of its weight may have a tendency to normally bulge the walls of its packaging, including, the container, the container having a series of walls, the walls having an interior and exterior surface, a bulk material bin located within said container, said bin having a series of walls, a pair of said bin walls arranged contiguous with the interior surface of a pair of said container walls, and said bin having two other walls which are spaced inwardly from the interior surface of the other two container walls, a series of beveled walls, one of each beveled wall being arranged intermediate each of the adjacent walls of the formed bin for the structured package, wherein said container and its bin can be folded together into a flattened condition during non-usage.

26. The package of claim 25 wherein said bin walls maintained contiguous with the interior surface of the adjacent container walls being adhesively connected thereto.

27. The package of claim 26 wherein said bin walls maintained contiguous with the interior surface of the adjacent container walls being unattached thereto, and capable of sliding contact therewith during the folding or erecting of the container into its flattened or usable conditions.

* * * * *